United States Patent [19]

Shea et al.

[11] 4,224,069

[45] Sep. 23, 1980

[54] TRANSPORTATION STABLE MAGNESIUM AND IRON DILUENT PARTICLE MIXTURES FOR TREATING MOLTEN IRON

[75] Inventors: Michael M. Shea; John F. Watton, both of Mt. Clemens, Mich.

[73] Assignee: General Motors Corporation, Detroit, Mich.

[21] Appl. No.: 926,080

[22] Filed: Jul. 19, 1978

Related U.S. Application Data

[63] Continuation-in-part of Ser. No. 812,757, Jul. 5, 1977.

[51] Int. Cl.[2] ..... B22F 9/00

[52] U.S. Cl. ..... 75/255; 75/58; 75/130 A; 164/57

[58] Field of Search ..... 75/53, 58, 130 A, 130 AB, 75/251, 252, 255, 256; 164/57, 58, 59

[56] References Cited

U.S. PATENT DOCUMENTS

| | | | |
|---|---|---|---|
| 3,637,373 | 1/1972 | Bylund et al. | 75/130 A |
| 3,961,663 | 6/1976 | Degois et al. | 164/58 |

FOREIGN PATENT DOCUMENTS

| | | | |
|---|---|---|---|
| 1031196 | 6/1966 | United Kingdom | 75/58 |

OTHER PUBLICATIONS

Dunks, C. M., et al. "Mold Nodulizing and Continuous Stream Treatment Techniques as Operated in Europe", A.F.S. Transactions vol. 82, pp. 391-406, (1974).

*Primary Examiner*—L. Dewayne Rutledge
*Assistant Examiner*—Michael L. Lewis
*Attorney, Agent, or Firm*—Elizabeth F. Goldberg

[57] ABSTRACT

In accordance with the invention, homogeneous bulk mixtures of about one weight part magnesium metal particles per 12 to 20 weight parts iron constituent particles are formed. The bulk mixtures are transportation and storage stable so that portions thereof may be randomly withdrawn to predictably and consistently inoculate molten iron in the mold to produce nodular iron castings. Substantially all the particles are about the same size and in the size range of from about 0.15 to 5.0 mm. The size characterization values of the magnesium and iron diluent particles are each in the range of from about 1 to 2.3, the size characterization value herein being defined as the ratio of the screen opening in millimeters retaining ten weight percent of a sample and the screen opening in millimeters retaining 90 weight percent of the same sample.

3 Claims, 3 Drawing Figures

TRANSPORTATION STABLE MAGNESIUM AND IRON DILUENT PARTICLE MIXTURES FOR TREATING MOLTEN IRON

This application is a Continuous-in-Part of our copending application Serial No. 812,757 filed July 5,1977.

This invention relates to transportation and storage stable bulk mixtures of magnesium metal particles and iron diluent particles particularly useful for treating molten cast iron in the mold to make nodular iron castings. More particularly, the invention relates to the characterization of suitable magnesium and iron diluent particle sizes and size distributions which form such stable mixtures.

BACKGROUND OF THE INVENTION

Our copending application Ser. No. 812,757 teaches an improved method of making nodular iron castings by treating molten iron in the runner system of a mold with a mixture of magnesium metal particles and iron diluent particles. Contrary to prior art teachings, we descovered that unalloyed magnesium metal may be used successfully in the mold, without excessive fuming or pyrotechnics, when the additive comprises a homogeneous mechanical blend of magnesium and iron diluent particles. All the particles are substantially in the size range of from about 0.15 to 5 mm, and the weight ratio of magnesium to iron is in the range of from about 1:12 to 1:20. Use of our mixtures insures more consistent treatment from mold to mold, and less magnesium waste due to magnesium loss in producing prealloyed magnesium-ferrosilicon alloy inoculants.

Our method of treating iron in the mold with magnesium metal was developed using treatment-size particle batches of a few kilograms each. In the foundry it would be inconvenient to mix up a separate small batch of nodularizing additive for each mold. It is much more desirable to provide the foundryman with our particulate additives in premixed bulk quantities from which small portions may be withdrawn for in-the-mold treatments. However, all mixtures of magnesium and iron diluent particles in the 0.15 to 5.00 mm range are not stable during transportation and storage. In some, the smaller particles segragate toward the bottom of a container, and the magnesium particles become unevenly dispersed throughout the mixture. Neither of these situations is tolerable where the success of the iron treatment method depends on the predictability of the magnesium content of a given weight of additive.

Thus, it is an object of this invention to provide large batches of homogeneously mixed magnesium metal and iron diluent particles from which smaller portions may be randomly withdrawn to predictably and consistently inoculate molten iron. It is a more specific object to provide the foundryman with bulk premixed batches of such particles which batches are transportation and storage stable in drums or other large containers so that small amounts can be taken therefrom to treat molten iron in the runner of a mold and form nodular iron castings. It is another object to provide unalloyed magnesium-iron diluent particle mixtures such that the overall size distribution of particles throughout is substantially uniform and the relative magnesium to diluent content of random samples of the mixture is also substantially constant. It is yet another object to specify, before mixing, which stocks of magnesium and iron diluent particles can be combined to form our transportation and storage stable mixtures. It is a further object to specify allowable relative size ranges between the magnesium and the iron diluent particles for such mixtures.

BRIEF SUMMARY OF THE INVENTION

In accordance with the invention, transportation and storage stable bulk mixtures of particulate magnesium metal and iron diluents are provided. These mixtures are particularly useful for treating low sulfur cast iron in foundry molds to make spherulitic graphite castings. A significant benefit of our particulate mixture is that a large working quantity may be prepared at any convenient location and thereafter stored and shipped as needed in large containers. It may be handled as necessary in the foundry or elsewhere with the assurance that each random portion subsequently taken from the working batch to make a nodular iron casting will contain the desired and expected amount of magnesium.

A preferred mixture consists of from about a 1:12 to a 1:20 weight ratio of magnesium metal particles to ferrosilicon (50% silicon) alloy particles where substantially all the particles are about the same size and in the size range of from about 0.15 mm to 5.0 mm. Homogeneous bulk mixtures are formed by blending the particles in any suitable mechanical mixing means. We have discovered that agitation encountered during transportation and use will not cause the mixed particles to appreciably segregate according to size; i.e. the smaller particles will not settle out to any significant degree when substantially all the particles are about the same size and when the relative sizes of the magnesium and iron diluent particles fall within a certain range. With respect to the former, the particle size characterization values of both the magnesium and iron diluent particles, before mixing, should be in the range from about 1 to 2.3. Herein, the size characterization value (v) of a quantity of magnesium or iron particles is defined as the ratio of the screen opening (in millimeters) retaining 10 weight percent of a random particle sample to the screen opening (in millimeters) retaining 90 weight percent of the same sample. By random sample herein is meant a portion of a larger batch or stock of particles, the same being taken from any area of a container of the batch or stock. We have found that a sample of about 100 grams is adequate to experimentally evaluate the size distribution of the bulk particle stock from which it is taken with a high degree of confidence. With respect to the relative sizes of the magnesium and iron diluent particles we discovered that the magnesium content of samples withdrawn from a bulk magnesium-iron diluent particle additive mixture will not vary more than about 20 percent from the average magnesium content of the entire batch if the relative size of the iron diluent to the magnesium particles is in the range of from about 0.8 to 1.7.

DETAILED DESCRIPTION OF THE INVENTION

Our invention will be more fully appreciated and clearly understood from the detailed description which follows. Reference will be made to the drawings in which.

Figure 3:
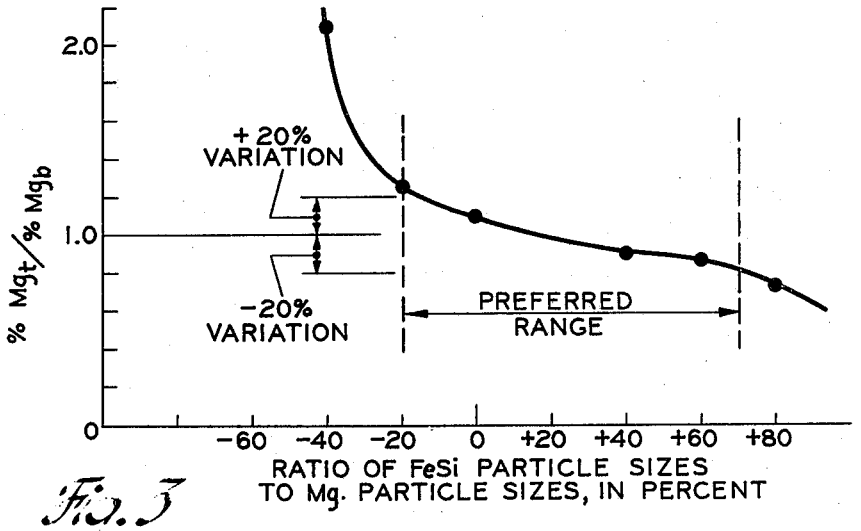

FIG. 3 is a plot of the magnesium content variation between the top and bottom of a container of premixed magnesium and ferrosilicon particles as a function of the ratio of FeSi particle sizes to magnesium particle sizes in the mixture expressed as a percentage. The segregation value is expressed as the ratio of the percent magnesium in a sample taken from the top of a container ($\%Mg_t$) to that in the sample taken from the bottom ($\%Mg_b$).

Forming homogeneous mixtures of 0.15 to 5.0 mm size magnesium metal and iron diluent particles in amounts required to treat iron for a single casting in the mold, e.g., about 1 kilogram additive for a 100 kilogram casting at a 1:15 magnesium to diluent particle weight ratio, presents few problems. However, it is much preferred to premix a large batch of magnesium and iron diluent particles, e.g., a thousand kilograms or more, and take treatment-size portions from the large batch to inoculate the molds. Forming a transportation and storage stable mixture is aggravated, at least in part, by the disparity of the relative specific gravities of magnesium metal (1.74 g/cm$^3$) and the iron diluent, e.g., ferrosilicon (50% silicon) (5.14 g/cm$^3$). While our additives may also be used, e.g., to desulfurize iron or treat iron in a ladle to form nodular iron, thus far its primary utility is for in-the-mold nodularizing treatments.

Earlier we discovered that mixtures of magnesium metal and iron diluent particles all in the size range from about 0.15 to 5 mm may be used to effectively treat molten iron in the mold to form nodular iron castings. However, all mixtures of such particles are not stable during transportation and storage. In some mixtures, the smaller particles will settle out to the bottom and/or the magnesium particles will not remain uniformly dispersed throughout. Such unstable mixtures are unacceptable for foundry practice because equal weight amounts of the mixture may contain different weight amounts of the magnesium metal nodularizing agent.

To provide a bulk amount of a stable particle mixture, the magnesium and iron diluent feedstocks must themselves be resistant to settling and capable of being uniformly blended. Examples I and II pertain to the means by which a practitioner may characterize suitable starting materials. Once formed, pouring and agitation should not affect the homogeneity of the mixture. We have discovered that the relative sizes of the magnesium and iron constituent particles effect stability of their mixtures. Example III relates to the determination of suitable relative particle size ranges. Example IV pertains to the formation, transportation and use of a large batch of our material.

EXAMPLE I

Particle Size Characterization

A size distribution curve for particles from a stock of −10+28 mesh crushed ferrosilicon (particles passing through a 10 mesh screen but hanging up on a 28 mesh screen) was determined as follows.

A 1 kilogram particle sample was riffled through a sample splitter and approximately 500 grams were retained.

Figure 1:
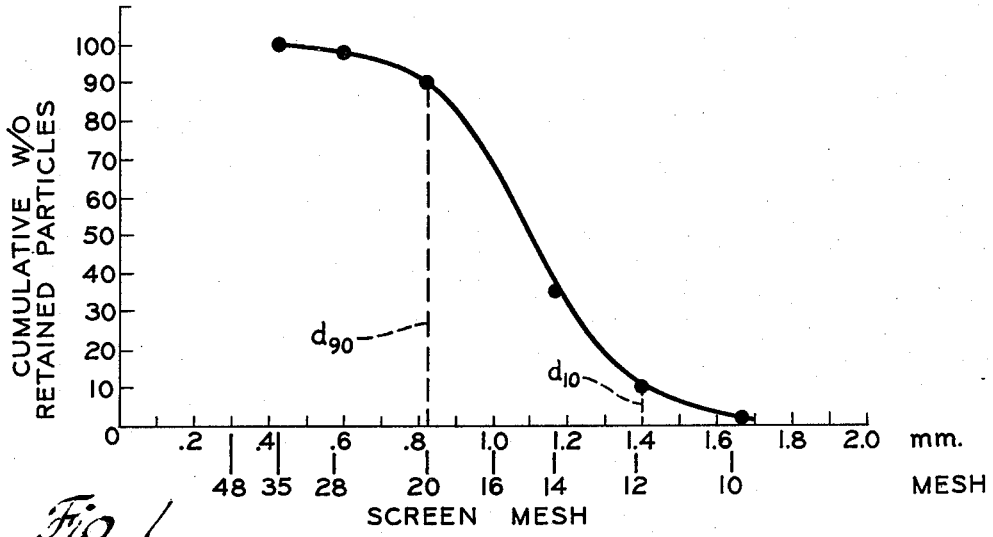
FIG. 1 is a plot of the size distribution of a sample -31 10+28 mesh crushed ferrosilicon particles where the x coordinate is the screen mesh size (in mesh sizes and millimeters) and the y coordinate is the cumulative weight percent particles retained on a screen of a given size.

The riffling step was taken to provide as random a size sampling of particles as possible. The size distribution was made with an automatic screening device, a Ro-tap manufactured by W. S. Tyler Company, comprising means for mounting nested, screen-bottomed pans in a frame. The mounting frame is provided with translational motion means at one end and circular motion means at the other to provide continual movement of particles on the screens. One blow is delivered to the nest of sieves for each revolution of the frames. For our experiments, a nest of 10, 12, 14, 20, 28, and 35 mesh screens (1.65, 1.41, 1.17, 0.83, 0.59, and 0.42 mm screen openings, respectively) was assembled. The coarsest screen (i.e., 10 mesh) was positioned on the top with progressively finer meshed screens beneath. The 500 g sample was poured into the top screen pan and the assembly agitated on the Ro-tap for 5 minutes. The amount of material retained on each screen was weighed. Referring to FIG. 1, the y-coordinate represents the cumulative weight percent ferrosilicon particles retained on a particular screen. The x-coordinate corresponds to screen mesh. The Y-value for a particular screen mesh was determined by adding the weight of the particles retained on that screen plus the weights of the particles retained on all larger mesh screens above it and dividing the sum by the total weight of the sample. For example, the cumulative percent retained on the 14 mesh screen was determined by adding the weights of the particles on the 10, 12 and 14 mesh screens, dividing the sum by the total weight of the particles and multiplying by 100. Thecurve of FIG. 1 generally represents a slightly skewed normal particle size distribution.

A convenient way of characterizing a sample of particles is to take the ratio of the size of some of the largest particles and that of some of the smallest. In the above-described distribution, a particle size characterization value (v) for the sample was calculated by taking the ratio of the screen opening in millimeters retaining 10 weight percent or some of the largest particles of the sample, $d_{10}$, and the screen opening in millimeters retaining 90 weight percent, or some of the smallest particles, of the sample $d_{90}$. Eighty percent or substantially all of the particles in the mixture fall within the range defined by the two screen openings. For the sample shown in FIG. 1, v is approximately equal to 1.68.

A number of other magnesium and ferrosilicon stock samples of different mesh particles in the 0.15 to 5.00 mm range were also tested. The characterization value of each sample was calculated. The higher the v value for a particular sample, the greater the disparity of particle sizes within it and the greater the difficulty in using it to form a stable particle mixture.

EXAMPLE II

Effect of Particle Size Distribution on Settling

The individual magnesium and ferrosilicon samples of Example I were further tested to determine whether the particles therein would settle with the kind of agitation that could be encountered during transport of drums, or other containers of the particles.

Each sample was separately remixed in a twin shell blender for five minutes to reform a uniform particle mixture. The samples were then poured to almost fill glass jars about 10 cm high with an inside diameter of about 4.4 cm. The jars were agitated on the Ro-tap for 30 minutes and a 100-gram portion was taken respectively from the top and bottom of each jar. The size distribution value ($d_{10}/d_{90}$) of each 100-gram portion was determined as in Example 1.

For each jar, the size distribution value for the 100 g top portion ($v_t$) was divided by that ($v_b$) for the bottom portion. A value of 1 indicates that particle size distributions at the top and bottom of the agitated mixture are about the same. As the ratio decreases from 1, the size distribution of the particles at the top and bottom becomes more widespread.

Figure 2:
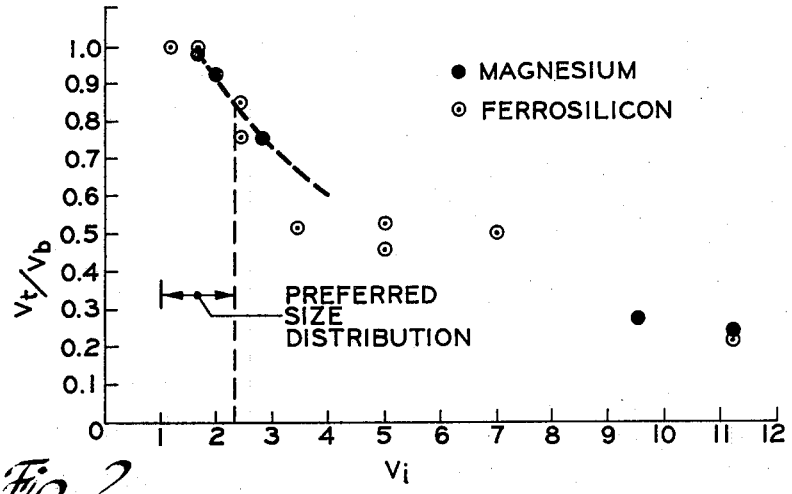
FIG. 2 is a plot of the size segregation of magnesium or ferrosilicon particles in a container after agitation. The x coordinate is the initial size distribution characterization value ($v_i$) of particles in the container, and the y coordinate is the ratio of the size characterization values ($v_t/v_b$) of samples taken from the top and bottom of the container after agitation.

FIG. 2 is a graph of the ($v_t/v_b$) for a number of samples plotted as a function of the initial size distribution ($v_i$) of the sample particles before agitation of the jars. Data points designated "⊙" represent ferrosilicon samples and those designated "●" magnesium samples. We have discovered that if the $v_t/v_b$ for both the magnesium and iron diluent constituents of a desired additive mixture are in the range of from about 0.85 to 1.0, a transportation and storage stable mixture can be formed from them. As seen at FIG. 2, the $v_1$ values corresponding to $v_t/v_b$ in the 0.85 to 1.0 range are between about 1.0 and 2.3. Thus, a person desiring to form a homogeneous nodularizing additive particle mix should begin with magnesium and iron diluent particles in the 0.15 to 5.00 mm size range, each with $d_{10}/d_{90}$ values in the range of from about 1.0 to 2.3.

EXAMPLE III

Relative Sizes of the Magnesium and Ferrosilicon Particles

The magnesium content of a random sample taken from a bulk mixture of magnesium metal and iron diluent particles should be about the same as that in the bulk. For in-the-mold inoculation of iron, up to about a 20 percent magnesium content variation from the average is tolerable to achieve predictably good castings with suitable weight portions of additive. To achieve this end, our mixtures are preferably made from stocks of magnesium and iron diluent particles of about the same size. The stocks are generally presieved to supply particles of a desired size range. The feedstock may be further characterized by running a size distribution curve as in Example I. We wished to determine the effect that varying relative sizes of magnesium and ferrosilicon particles has on maintaining an even dispersion of magnesium particles throughout a bulk mixture, particularly with the type of agitation that such mixture might encounter during transportation and storage. Thus, an experiment was conducted as follows: A particle size distribution curve was generated for −10+28 mesh granulated magnesium particles by the procedure set forth in Example I. Mixtures of sized ferrosilicon particles were then artificially synthesized so that each mixture contained particles that were a desired percentage from about 60% smaller to 80% larger than the corresponding particles in the magnesium sample. For example, a ferrosilicon mixture was formed wherein the particles were substantially all about 20% smaller than the corresponding particles in the −10+28 magnesium. Thus, the size distribution curve of the 20% smaller ferrosilicon mixture closely paralleled that of the magnesium.

Two hundred gram batches of 1:15; magnesium:ferrosilicon were mixed in a twin shell blender from each of the synthetic ferrosilicon mixtures and discharged into 4.4 cm inside diameter cylindrical containers. The magnesium content of the top 100 grams was compared to that of the bottom 100 to determine whether a homogeneous, pourable mixture had been formed. The ferrosilicon particles of the 100 gram samples was separated from the magnesium with an impact mill. Therein, the ferrosilicon is pulverized and sifted through a fine mesh screen while the more malleable magnesium is retained and weighed. Referring to FIG. 3, the percent magnesium in the top half of the container divided by the percent magnesium in the bottom half of the container was plotted as a function of the percentage the size of the ferrosilicon particles differed from the size of the magnesium particles. Application of the plot of FIG. 3 to a bulk mixture of magnesium and ferrosilicon particles indicates that magnesium particles will form a homogeneous mixture with the ferrosilicon and remain substantially uniformly dispersed upon pouring (i.e., within the allowed 20 percent variance from the average magnesium content) if the ferrosilicon particles are substantially in the preferred relative range of from about 0.8 to about 1.7 times the size of the magnesium particles.

EXAMPLE IV

A number of 2,250 kg. batches of 1:15 magnesium: ferrosilicon, screen analyses shown in Table I, were made up in a horizontal Zig-Zag®continuous blender manufactured by the Patterson-Kelly Corporation. One-hundred gram samples were randomly taken from the effluent of the blender and analyzed for magnesium content. The standard deviation of the magnesium content in all samples was within 0.4% of the mean magnesium content for the particular batch from which they were taken.

TABLE I

| Screen Mesh | FeSi(50% Si) Total w/o Retained | Mg Total w/o Retained |
|---|---|---|
| 8 | — | — |
| 10 | 15 | — |
| 12 | 35 | 9 |
| 14 | 52 | 21 |
| 20 | 87 | 68 |
| 28 | 97 | 98 |
| 35 | 99 | 99 |
| 48 | 100 | 100 |

The blender was discharged directly into 300 and 500 pound drums, and 5,000-pound pallet boxes. The containerswere loaded onto trucks and transported several hundred miles. Some of the drums were retained on actively used trucks for two weeks before unloading.

Three 100-gram samples were taken, respectively, from the top, middle and bottom of each drum. The standard deviation of the magnesium content in all samples was found to be within 0.4% from the mean magnesium content of each drum. Screen analyses showed no substantial size segregation or settling of the particles, even those from the drums that had been vibrated for two weeks on the truck.

Ten 100-gram samples were withdrawn from the top, middle and bottom of each of the pallet boxes. Again, the standard deviation of the magnesium content in all samples was within 0.4% of the mean, and screen analyses showed no substantial size segregation or settling.

Thus, anyone practicing our invention may be assured that once suitably sized particles are homogeneously blended, they may be discharged into a desired container, transported long distances by a desired mode, and later used in the foundry with predictable results.

Four-hundred fifty kg. of the additive mixture of Example IV were used at a production foundry for treating molten iron (e.g., crankshafts, steering knuckles, disc brake calipers, differential carriers and cases) with magnesium in the mold in form nodular iron castings. A measured amount of the premixed magnesium and ferrosilicon particles was placed in the treatment chamber of each mold, the chamber being located in the runner system between the downsprue and the casting cavities such that poured metal would pass over and react with the additive mixture. Low sulfur iron (less than 0.02 weight percent sulfur) was cast into the molds at a pour rate no greater than 10 kg/sec and a temperature of about 1410° C.

Typically, about 175 kg metal was cast per mold with a net casting recovery weight of at least about 100 kg or more, depending on mold design. Representative treated castings were sectioned. Examination of their microstructures showed a high degree of nodularity with no primary carbides or contaminant inclusions. Chemistries showed a satisfactory magnesium recovery of at least 50% for each casting. The rest of the premixed particulate material was used at other foundries to inoculate iron both in-the-mold and in cupolas with results equal to or better than those achieved with more expensive and wasteful magnesium-ferrosilicon alloys.

By magnesium metal herein is meant substantially pure elemental magnesium generally produced either by the electrolysis of sea water or the electrolytic reduction of magnesite ore. Each of these methods yields magnesium metal of about 99.8% purity with traces of copper, iron, manganese, nickel, lead, silicon, tin and possibly other metallic elements. For in-the-mold treatment of cast iron, the magnesium metal does not have to be of exceptional purity since traces of other elements do not substantially affect the nodularizing activity of the magnesium. Both relatively round atomized magnesium particles and milled magnesium particles were successfully employed in our mixtures.

Ferrosilicon is a preferred iron diluent for our nodularizing additives because the silicon contained therein is a graphite promoter and carbide inhibitor. Other elements, such as aluminum, calcium, barium and the rare earths may also be included separately or in the ferrosilicon alloys to tie up trace elements or to impart other desirable properties to a treated casting. Typical inoculant alloys are comprised of from 40 to about 98 percent by weight silicon in combination with iron and small amounts of other elements. Other iron-based materials, such as sized steel or cast iron machinings, sponge iron, or iron alloys, may also be used in lieu of or with ferrosilicon to control the dissolution rate of our magnesium containing additive mixtures.

The mechanical mixer used to combine the elemental magnesium and iron diluent particles should thoroughly blend the particles without grinding any substantial portion of them into pieces much smaller than 0.15 mm.

While our invention has been described in terms of specific embodiments thereof, it will be appreciated that other forms could readily be adapted to one skilled in the art. Accordingly, the scope of our invention is to be considered limited only by the following claims.

The embodiments of the invention in which an exclusive property or privilege is claimed are defined as follows:

1. A bulk particulate mixture from which portions may be withdrawn to treat molten cast iron with a desired amount of magnesium, said mixture consisting essentially of a substantially homogeneous blend of one weight part magnesium metal particles and from about 12 to 20 weight parts iron constituent particles selected from the group consisting of iron and iron alloys, the size of substantially all the particles being in the range of from about 0.15 to 5.0 millimeters and the size distribution characterization value of the said magnesium particles and said iron constituent particles before mixing each being in the range of from about 1 to 2.3, said characterization value being defined as the ratio of the screen opening in millimeters retaining 10 weight percent of a sample of said particles to the screen opening in millimeters retaining 90 weight percent of the same sample, the ratio of the size distribution characterization value of the iron constituent particles to the magnesium particles being in the range of from about 0.8 to 1.7, the said size distributions of the magnesium and iron constituent particles cooperating in the bulk mixture to resist segregation of the magnesium during shipping, handling or storage.

2. A transportation stable bulk particulate mixture from which portions may be taken to treat molten cast iron in the runner system of a mold to produce a nodular iron casting, said mixture consisting essentially of a substantially homogeneous blend of one weight part magnesium metal particles and from about 12 to 20 weight parts iron constituent particles selected from the group consisting of iron and ferrosilicon, the size of substantially all the particles being in the range of from about 0.15 to 5.0 millimeters and the size distribution characterization value of said magnesium and said iron constituent particles each being in the range of from about 1 to 2.3 before mixing, said characterization value being defined as the ratio of the screen opening in millimeters retaining ten weight percent of a sample of said particles to the screen opening in millimeters retaining 90 weight percent of the same sample, and the ratio of the size distribution characterization value of the ferrosilicon constituent particles to the magnesium particles being in the range of from about 0.8 to 1.7.

3. A bulk particulate mixture for treating molten cast iron with magnesium, said mixture consisting essentially of a blend of one weight part magnesium metal particles and from about 12 to 20 weight parts iron constituent particles selected from the group consisting of iron and iron alloys, the size of substantially all of the particles being in the range of from about 0.15 to 5.0 millimeters and the size distribution characterization value of the said magnesium particles and the said iron constituent particles before they are mixed each being in the range of from about 1 to 2.3, said characterization value being defined as the ratio of the screen opening in millimeters retaining ten weight percent of a sample of said particles to the screen opening in millimeters retaining 90 weight percent of said sample, and wherein the magnesium content of any portion of said bulk mixture varies no more than about 20% from the average magnesium content of the entire bulk mixture even after agitation and storage.

* * * * *